US008796926B2

(12) United States Patent
Eden et al.

(10) Patent No.: US 8,796,926 B2
(45) Date of Patent: Aug. 5, 2014

(54) AC, RF OR PULSE EXCITED MICRODISCHARGE DEVICE AND ARRAY

(75) Inventors: J. Gary Eden, Mahomet, IL (US); Ju Gao, Champaign, IL (US); Sung-o Kim, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 1684 days.

(21) Appl. No.: 11/899,083

(22) Filed: Sep. 4, 2007

(65) Prior Publication Data

US 2009/0128031 A1 May 21, 2009

Related U.S. Application Data

(63) Continuation of application No. 10/829,666, filed on Apr. 22, 2004, now Pat. No. 7,372,202.

(51) Int. Cl.
*H01J 17/49* (2012.01)
*H01J 17/04* (2012.01)

(52) U.S. Cl.
USPC ..... 313/582; 313/586; 313/587; 313/631; 372/61

(58) Field of Classification Search
None
See application file for complete search history.

(56) References Cited

U.S. PATENT DOCUMENTS

| | | | | |
|---|---|---|---|---|
| 3,811,061 | A * | 5/1974 | Nakayama et al. | 313/518 |
| 4,367,554 | A | 1/1983 | Schlossberg | |
| 4,475,060 | A | 10/1984 | Aboelfotoh | |
| 4,720,706 | A | 1/1988 | Stine | |
| 4,803,402 | A | 2/1989 | Raber et al. | |
| 4,843,281 | A | 6/1989 | Mendelsohn | |
| 4,956,577 | A | 9/1990 | Parker | |
| 5,132,811 | A | 7/1992 | Iwaki et al. | |
| 5,723,945 | A * | 3/1998 | Schermerhorn | 313/581 |
| 5,984,747 | A | 11/1999 | Bhagavatula et al. | |
| 6,016,027 | A | 1/2000 | DeTemple et al. | |
| 6,043,604 | A | 3/2000 | Horiuchi et al. | |
| 6,194,833 | B1 | 2/2001 | DeTemple et al. | |
| 6,456,007 | B1 | 9/2002 | Ryu et al. | |
| 6,695,664 | B2 * | 2/2004 | Eden et al. | 445/24 |
| 6,867,548 | B2 * | 3/2005 | Eden et al. | 315/56 |
| 7,026,640 | B2 | 4/2006 | Nathan et al. | |
| 7,511,426 | B2 * | 3/2009 | Eden et al. | 313/582 |
| 2002/0030437 | A1 * | 3/2002 | Shimizu et al. | 313/495 |
| 2003/0080688 | A1 | 5/2003 | Eden et al. | |
| 2003/0173900 | A1 * | 9/2003 | Inan et al. | 313/587 |
| 2006/0038490 | A1 | 2/2006 | Eden et al. | |

(Continued)

OTHER PUBLICATIONS

D.G. Youmans, "Phase Locking of Adjacent Channel Leaky Waveguide $CO_2$ Lasers", *Appl. Phys. Lett.* 44(4), Feb. 15, 1984, pp. 365-367.

(Continued)

*Primary Examiner* — Sikha Roy
(74) *Attorney, Agent, or Firm* — Greer, Burns & Crain, Ltd.

(57) ABSTRACT

An AC, rf, or pulse-excited microdischarge device and array are provide by the invention. A preferred array includes a substrate. A plurality of microdischarge cavities that contain discharge medium are in the substrate. A transparent layer seals the discharge medium in the microdischarge cavites. Electrodes stimulate the discharge medium. The microdischarge cavities are physically isolated from the electrodes by dielectric and arranged relative to the electrodes such that ac, rf, or pulsed excitation applied to the electrodes stimulates plasma excitation of the discharge medium. The microdischarge cavities are sized to produce plasma within the microdischarge cavities.

10 Claims, 3 Drawing Sheets

(56) References Cited

U.S. PATENT DOCUMENTS

| | | | | |
|---|---|---|---|---|
| 2006/0071598 | A1 | 4/2006 | Eden et al. | |
| 2006/0084262 | A1 | 4/2006 | Qin | |
| 2007/0108910 | A1 | 5/2007 | Eden et al. | |
| 2007/0114929 | A1 | 5/2007 | Son | |
| 2008/0018248 | A1* | 1/2008 | Jung et al. | 313/582 |
| 2008/0116805 | A1* | 5/2008 | Song | 313/586 |

OTHER PUBLICATIONS

L.A. Newman, R.A. Hart, J.T. Kennedy, A.J. Cantor, A.J. DeMaria, "High Power Coupled $CO_2$ Waveguide Laser Array", *Appl. Phys. Lett*. 48 (25), Jun. 23, 1986, pp. 1701-1703.

J.E. Ripper, T.L. Paoli, "Optical Coupling of Adjacent Stripe-Geometry Junction Lasers", *Applied Physics Letters*, vol. 17, No. 9, Nov. 1, 1970, pp. 371-373.

J. Katz, S. Margalit, A. Yariv, "Diffraction Coupled Phase-Locked Semiconductor Laser Array", *Appl. Phys. Lett*. 42 (7), Apr. 1, 1983, pp. 554-556.

M. Oka, H. Masuda, Y. Kaneda, S. Kubota, "Laser-Diode-Pumped Phase-Locked Nd:YAG Laser Arrays", *IEEE Journal of Quantum Electronics*, vol. 28, No. 4, Apr. 1992, pp. 1142-1147.

Sung-Jin Park, Jack Chen, Clark J. Wagner, Chang Liu, J. Gary Eden, "Microdischarge Arrays: A New Family of Photonic Devices", *IEEE Journal on Selected Topics in Quantum Electronics*, vol. 8, No. 1, Jan./Feb. 2002, pp. 139-147.

* cited by examiner

AC, RF OR PULSE EXCITED MICRODISCHARGE DEVICE AND ARRAY

PRIORITY CLAIM AND REFERENCE TO RELATED APPLICATION

This application is a continuation of and claims the benefit of the filing date under 35 U.S.C. 120 of prior related application Ser. No. 10/829,666, entitled Phase Locked Microdischarge Array and AC, RF or Pulse Excited Microdischarge, which was filed on Apr. 22, 2004 now U.S. Pat. No. 7,372,202.

STATEMENT OF GOVERNMENT INTEREST

This invention was made with Government assistance under U.S. Air Force Office of Scientific Research grant No. F49620-00-1-0372. The Government has certain rights in this invention.

FIELD OF THE INVENTION

A field of the invention is microdischarge devices and arrays.

BACKGROUND OF THE INVENTION

Microcavity plasma devices produce a nonequilibrium, low temperature plasma within, and essentially confined to, a cavity having a characteristic dimension d below approximately 500 μm. This new class of plasma devices exhibits several properties that differ substantially from those of conventional, macroscopic plasma sources. Because of their small physical dimensions, microcavity plasmas normally operate at gas (or vapor) pressures considerably higher than those accessible to macroscopic devices. For example, microplasma devices with a cylindrical microcavity having a diameter of 200-300 μm (or less) are capable of operation at rare gas (as well as $N_2$ and other gases tested to date) pressures up to and beyond one atmosphere.

Such high pressure operation is advantageous. An example advantage is that, at these higher pressures, the plasma chemistry favors the formation of several families of electronically-excited molecules, including the rare gas dimers ($Xe_2$, $Kr_2$, $Ar_2$, . . . ) and the rare gas-halides (such as XeCl, ArF, and $Kr_2F$) that are known to be efficient emitters of ultraviolet (UV), vacuum ultraviolet (VUV), and visible radiation. This characteristic, in combination with the ability of microplasma devices to operate in a wide range of gases or vapors (and combinations thereof), offers emission wavelengths extending over a broad spectral range. Furthermore, operation of the plasma in the vicinity of atmospheric pressure minimizes the pressure differential across the packaging material when a microplasma device or array is sealed.

Early microplasma devices were driven by direct current (DC) voltages and exhibited short lifetimes for several reasons, including sputtering damage to the metal electrodes. Improvements in device design and fabrication have extended lifetimes significantly, but minimizing the cost of materials and the manufacture of large arrays continue to be key considerations.

SUMMARY OF THE INVENTION

An AC, rf, or pulse-excited microdischarge device and array are provide by the invention. A preferred array includes a substrate. A plurality of microdischarge cavities that contain discharge medium are in the substrate. A transparent layer seals the discharge medium in the microdischarge cavites. Electrodes stimulate the discharge medium. The microdischarge cavities are physically isolated from the electrodes by dielectric and arranged relative to the electrodes such that ac, rf, or pulsed excitation applied to the electrodes stimulates plasma excitation of the discharge medium. The microdischarge cavities are sized to produce plasma within the microdischarge cavities.

DETAILED DESCRIPTION OF THE PREFERRED EMBODIMENTS

Embodiments of the invention concern an AC, rf, or pulse-excited microdischarge device and array. A preferred array includes a substrate. A plurality of microdischarge cavities that contain discharge medium are in the substrate. A transparent layer seals the discharge medium in the microdischarge cavites. Electrodes stimulate the discharge medium. The microdischarge cavities are physically isolated from the electrodes by dielectric and arranged relative to the electrodes such that ac, rf, or pulsed excitation applied to the electrodes stimulates plasma excitation of the discharge medium. The microdischarge cavities are sized to produce plasma within the microdischarge cavities.

The invention will now be illustrated by discussing several preferred embodiment devices. In describing the invention, particular exemplary devices, formation processes, and device applications will be used for purposes of illustration. Dimensions and illustrated devices may be exaggerated for purposes of illustration and understanding of the invention. The elements of the drawings are not necessarily to scale relative to one another. Schematic views will be understood by artisans as such views are commonly used in the art. Devices and arrays of the invention may be fabricated by processes well known to the semiconductor device and MEMs communities.

Figure 1:
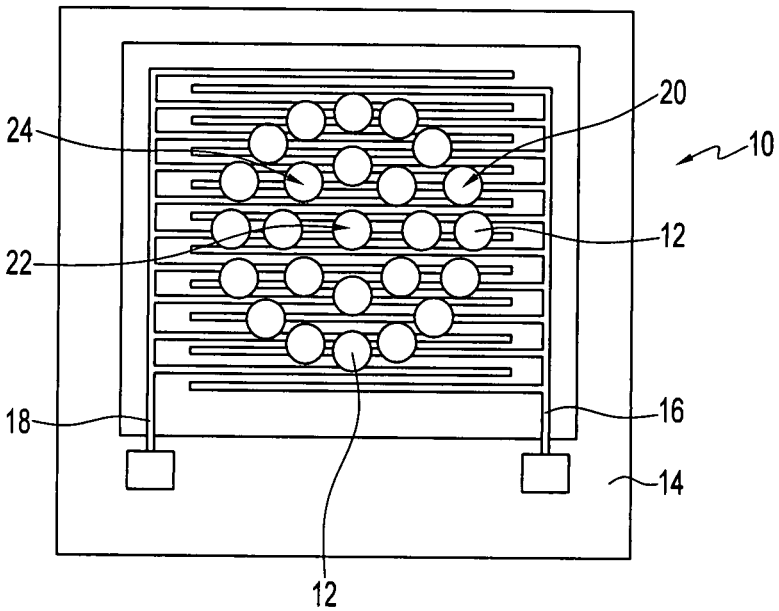
FIG. 1 shows a schematic top view of an exemplary embodiment microdischarge array light source.
Figure 2:
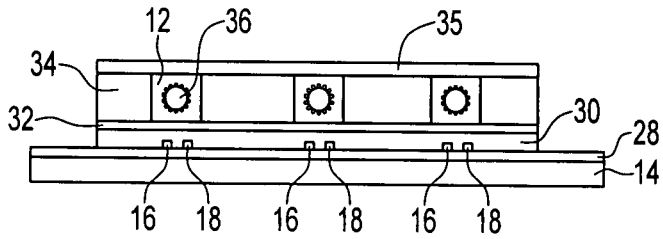
FIG. 2 shows a schematic cross-section of a the FIG. 1 device.

Referring now to FIGS. 1 and 2, a microdischarge array 10 comprising a plurality of microdischarge cavities 12 is shown. In the view of FIG. 1, the emission direction is out of the plane of the page. The array 10 of microdischarge cavities 12 is formed on a substrate 14, which can be, for example, a photosensitive glass. Interdigitated electrodes 16, 18 form electrode pairs that provide excitation to create a time-varying electromagnetic field in the microdischarge cavities, e.g., ac, RF, or pulsed excitation to the microdischarge cavities 12. The peak strength of the electric field produced in the microdischarge cavities must be sufficient to cause the production of plasma within the microdischarge cavities. Though not illustrated in FIG. 1, the electrodes 16, 18 may be connected to control circuitry, and the array itself may form part of an integrated circuit. In the embodiment of FIG. 1 the central microcavity (pixel) 22 and rings 20 and 24 of microdischarges are excited by an electromagnetic field created by the electrodes when power (e.g., ac, RF, or pulsed power) is applied. However, it is straightforward to arrange the electrodes so that only the outermost ring 20 or the innermost pixel 22 or the middle ring 24 (or combinations thereof) are excited. In this manner, the rings 20-24 may be separately controlled. This effect can be used to alter the focal length.

An example prototype array is composed of 100 μm dia. microdischarge pixels. The visible light is produced by an ac discharge in neon gas in each microcavity and pairs of excitation electrodes can be seen in each of the microdischarges.

Referring again to FIG. 2, the array 10 is shown as being formed upon the substrate 14, which as another example might be a silicon wafer. The substrate also, for example, might be selected from the Group III-V semiconductor materials. In still other embodiments, the substrate may be plastic, glass, or another solid material onto which the remaining structure may be formed. For the array 10 of FIG. 2 formed on the silicon wafer or other semiconductor substrate, an insulating layer 28, e.g., silicon dioxide, provides electrical isolation from the electrodes 16, 18, which may be connected through the insulating layer 28 to other circuits on the substrate 14. A dielectric layer 30 prevents breakdown between the electrodes and may be chosen from a variety of well-known materials such as polyimide, silicon nitride, or silicon dioxide. A protective layer 32 is a robust dielectric such as magnesium oxide. The layers 30 and 32 are thin, preferably a few microns, as at least the peak electric field strength generated in the microdischarge cavities must be sufficient to produce a discharge in the gas(es) or vapors within the cavities.

Each microcavity 12 is formed in another substrate 34, for example, a dielectric material for electrically isolating each microcavity 12 from others. The dielectric substrate 34 is essentially transparent at a frequency of interest, namely, the frequency for phase locking. The transparency of the material of 34 may extend over a wavelength range encompassing two or more wavelengths produced by the microdischarges (output of the microdischarge cavities 12), thereby allowing two or more wavelengths to be phase-locked. Alternatively, substrate 34 may be chosen so as to be essentially transparent at only one wavelength. Thus, substrate 34 isolates each microdischarge electrically but couples the microdischarges optically at least one wavelength.

A transparent top window 35 fabricated from a layer of transparent material such as glass or quartz, is bonded or otherwise sealed to the substrate 34. The bottom electrodes 16, 18 produce an electric field that excites the vapor or gas discharge medium 36 contained within the microdischarge cavities 12. The window, i.e., fabricated from a substance transparent to the wavelength(s) of interest, 35 seals the discharge medium 36—a vapor or gas—in the microdischarge cavities 12. Application of power to the electrodes 16, 18 results in optical emissions from the discharge medium 36. If individual control of various microdischarge cavities 12 is not desired, common electrodes, such as electrodes 16, 18, are used to excite discharges in the microdischarge cavities 12, while multiple electrode pair embodiments may provide individual control, such as selective excitation of only rings 20 and 24.

The lower size limit of the diameter of the microdischarge cavities 12 in which the microdischarges are generated is limited primarily by the microfabrication techniques used to form the microdischarge cavities. Although the microdischarge cavities (for the prototype phased arrays produced to date) are cylindrical and have typical diameters of 75 or 100 μm, fabricating microplasma devices of much smaller (<10 μm) or larger sizes is straightforward with well-known microfabrication techniques. Also, the cross-section of the individual microdischarge devices need not be circular, though that is the shape of the microdischarge cavities 12 in the exemplary embodiment of FIGS. 1 and 2.

The size(s) of the individual devices and the overall array are determined by several considerations. To achieve phase-locked operation, the spacing between individual microdischarge devices and the cross-sectional dimensions of each device must be smaller than the coherence length of at least one of the radiative emission lines to be produced in the microdischarge array. The microdischarge devices may produce radiation at many disparate wavelengths and the array may be designed so as to phase lock radiation of a particular wavelength or a range in wavelengths.

One factor that determines the response of the array is the discharge medium 36 in the microdischarge cavities 12. Microdischarge devices operating in neon gas, for example, produce strong emission in the red region of the visible and weaker emission in the ultraviolet.

The material of the substrate 34 also impacts the response of the array. This may be used to control the wavelength of the phase-locked response of the array. For example, the array may be designed to achieve phase-locking in the red but not the ultraviolet. Phase-locking requires that the individual microdischarges (in microdischarge cavities 12) be optically coupled at the wavelength of interest. One way to accomplish this is to fabricate the microdischarge array in a material that is optically transmissive at the wavelength of interest. This allows optical radiation at the desired wavelength to pass from one microdischarge device and into an adjacent device.

Figure 3:
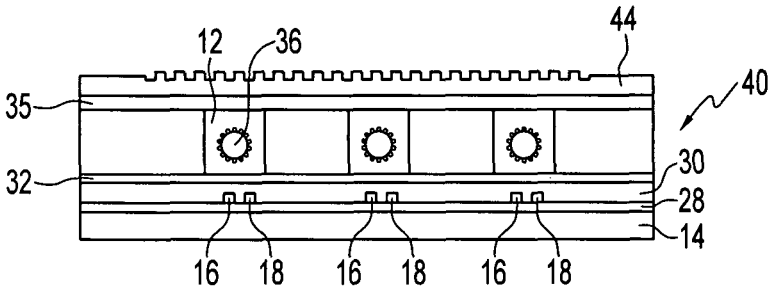
FIG. 3 is a schematic cross-section view of an exemplary embodiment microdischarge array.

Another approach is to cap the microdischarge array with a surface having a grating structure that optically couples at least two of the microdischarge cavities 12. The grating structure deflects radiation of a particular wavelength (or range of wavelengths), produced in one microdischarge device, into surrounding devices. FIG. 3 shows such an array 40. The array 40 is otherwise the same as the arrays of FIGS. 1 and 2, but includes a grating 44 for optically coupling microdischarge devices. For optimal performance, it is preferred that not simply two or more microdischarge devices (within microdischarge cavities 12) lie within one coherence length of one another but rather that each microdischarge cavity in the array lies within one coherence length of all other microdischarge cavities in the array.

Figure 4:
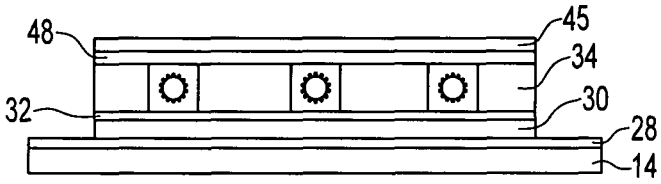
FIG. 4 is a schematic cross-section view of an exemplary embodiment microdischarge array.

FIG. 4 shows another embodiment, which is a variation of the FIG. 3 embodiment. In this case, the substrate 34 is formed of or carrying a conductive or semiconductor material, and the microdischarge cavities 12 are hollow cathode microdischarge cavities. The substrate 34 in this case forms a common cathode, and is isolated from a second electrode 45 (which is a material, such as indium tin oxide, that is preferably transparent at visible wavelengths) by an insulator film 48. In the FIG. 4 embodiment, the substrate 34, being itself conductive or semiconducting or, alternatively, supporting a semiconductive or conductive material on its surface in the microdischarge cavities 12, constitute an electrode making direct contact with the discharge medium and dc excitation (as well as ac, pulsed, RF, etc., excitation) may be used. Other electrode configurations are also possible for dc excitation, where an electrode is brought into direct contact with the discharge medium.

Another design consideration concerns preferred embodiment arrays arranged in a particular spatial configuration, a Fresnel pattern. If focusing of the light emerging from an array is desired, the microdischarge pixels can be disposed in rings. The radius of each ring is given by the expression $$\rho=\sqrt{2n\lambda b+n^2b^2} \quad (1)$$

where b is the desired focal length of the Fresnel array, n is the order (number) of the ring and λ is the wavelength of the light. It should be noted that the performance of the Fresnel lens improves with an increasing number of rings but we have found that skipping rings to obtain a larger spacing between rings of pixels also yields Fresnel structures that work well. From eqn. (1), it is clear that constructing active (microdischarge) Fresnel structures is most difficult at short wavelengths (λ) and with small focal lengths.

The small size of the microdischarge cavities, and the ability to pack the microdischarge cavities close together effectively creates point sources of radiation within a single coherence length of other adjacent microdischarge cavities. This provides the basis for a phased response of the array.

The type of discharge medium used in the microdischarge cavities 12 can alter the nature of the display. Discharge media in exemplary embodiments include a wide variety of vapors and gases such as the atomic rare gases, $N_2$, and the rare gas-halide molecules (i.e., rare gas-halogen donor gas mixtures). Each of the microdischarges is operated at pressures up to and beyond one atmosphere. Fabrication and the operation of microdischarges are discussed in the following U.S. patents that are incorporated by reference herein: U.S. Pat. No. 6,563,257 entitled Multilayer ceramic microdischarge device; U.S. Pat. No. 6,194,833 entitled Microdischarge lamp and array; U.S. Pat. No. 6,139,384 entitled Microdischarge lamp formation process; and U.S. Pat. No. 6,016,027 entitled Microdischarge lamp.

Figure 5:
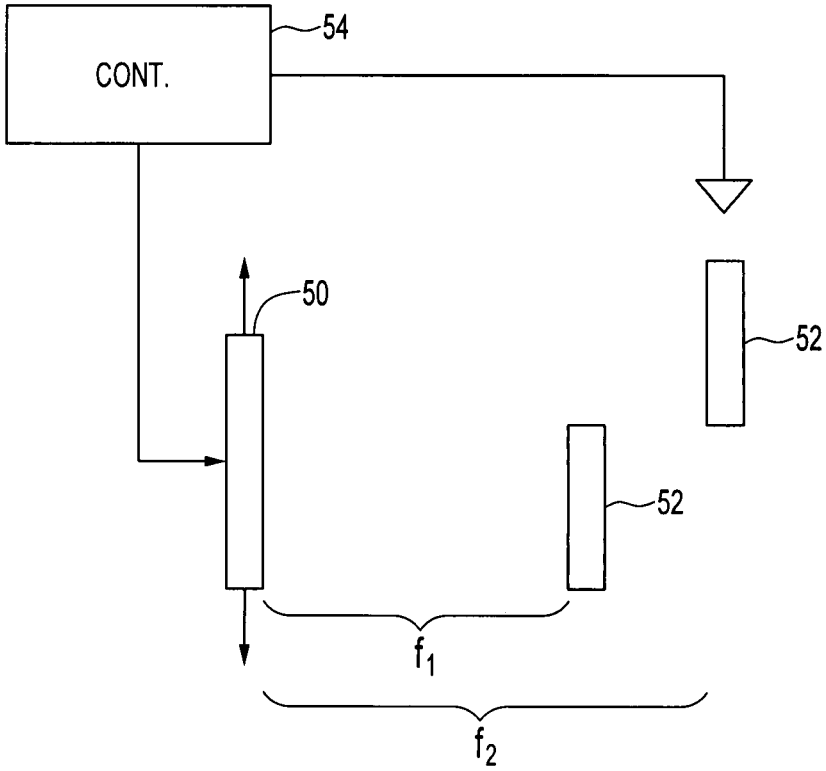
FIG. 5 is a block diagram of an exemplary embodiment system including a coherent light source target and a phase-locked microdischarge array.

Referring now to FIG. 5, an exemplary system of the invention is shown. An array or arrays of microdischarges 50 are disposed to direct light toward one or more targets 52. The target(s) may be disposed at different focal lengths, $f_1$ and $f_2$, away from the array 50, which might, for example have its focal length selectable by controlling the number of active rings in a Fresnel pattern of the array 50. A controller 54 directs the activation of the array, and might also, for example, cause one of the array 50 or targets 52 to move relative to one another by micropositioners. The targets may be any number of devices or materials such as memory media, display media, or transmission media such as optical fiber, a target in a flow cytometry system, etc.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A microdischarge device, comprising:

a substrate;

at least one pair of electrodes;

a microdischarge cavity in said substrate, said microdischarge cavity containing discharge medium and being physically isolated from said at least one pair of electrodes by dielectric and arranged relative to said at least one pair of electrodes such that ac, rf, or pulsed excitation applied to said pair of electrodes stimulates plasma excitation of said discharge medium, said microdischarge cavity being sized to produce plasma within the microdischarge cavity; and a transparent layer sealing the discharge medium in said microdischarge cavity.

2. The microdischarge device of claim 1, wherein said dielectric comprises a dielectric layer that isolates said at least one pair of electrodes from each other and said discharge medium.

3. The microdischarge device of claim 1, wherein said substrate comprises photosensitive glass, with said plurality of microdischarge cavities etched into said photosensitive glass.

4. The microdischarge device of claim 1, wherein said discharge medium is selected from the group consisting of the atomic rare gases, $N_2$, and the rare gas-halide molecules.

5. The microdischarge array of claim 1, wherein said discharge medium comprises neon gas.

6. An array of microdischarge devices comprising a plurality of a microdischarge devices of claim 1.

7. The array of claim 1, wherein said substrate comprises a dielectric substrate.

8. A microdischarge array, comprising:

a substrate;

a plurality of microdischarge cavities in said substrate, said microdischarge cavities containing discharge medium;

a transparent layer sealing the discharge medium in said microdischarge cavites; and electrodes for stimulating said discharge medium, wherein said microdischarge cavities are physically isolated from said electrodes by dielectric and arranged relative to said electrodes such that ac, rf, or pulsed excitation applied to said electrodes stimulates plasma excitation of said discharge medium, said microdischarge cavities being sized to produce plasma within the microdischarge cavities.

9. The array of claim 8, wherein said substrate comprises a semiconductor substrate.

10. The array of claim 8, wherein said substrate comprises a dielectric substrate.

* * * * *

UNITED STATES PATENT AND TRADEMARK OFFICE

CERTIFICATE OF CORRECTION

PATENT NO. : 8,796,926 B2
APPLICATION NO. : 11/899083
DATED : August 5, 2014
INVENTOR(S) : J. Gary Eden It is certified that error appears in the above-identified patent and that said Letters Patent is hereby corrected as shown below:

Title Page:

(57) ABSTRACT

Right Column, line 29, Abstract, line 2 Please delete "provide" and insert --provided-- therefor.

In the Specification:

Col. 1, line 66 Please delete "provide" and insert --provided-- therefor.

Signed and Sealed this
Second Day of June, 2015

Michelle K. Lee

Michelle K. Lee
*Director of the United States Patent and Trademark Office*